US007500476B2

(12) United States Patent
Tawarada et al.

(10) Patent No.: US 7,500,476 B2
(45) Date of Patent: Mar. 10, 2009

(54) ENGINE CYLINDER HEAD COVER WITH INTEGRAL BREATHER APPARATUS, AND ENGINE INCORPORATING SAME

(75) Inventors: Yuichi Tawarada, Saitama (JP); Takuya Yamasaki, Saitama (JP); Masashi Furuya, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 68 days.

(21) Appl. No.: 11/823,362

(22) Filed: Jun. 27, 2007

(65) Prior Publication Data

US 2008/0011280 A1 Jan. 17, 2008

(30) Foreign Application Priority Data

Jul. 13, 2006 (JP) ..... 2006-192429

(51) Int. Cl.
*F02M 13/04* (2006.01)

(52) U.S. Cl. ..... 123/572

(58) Field of Classification Search ..... 123/572–574, 123/41.86, 195 C, 193.5
See application file for complete search history.

(56) References Cited

U.S. PATENT DOCUMENTS

| | | | | |
|---|---|---|---|---|
| 5,005,553 | A * | 4/1991 | Washizu et al. | 123/572 |
| 2002/0083934 | A1 * | 7/2002 | Ruehlow et al. | 123/573 |
| 2002/0112710 | A1 * | 8/2002 | Akiwa et al. | 123/572 |
| 2003/0051680 | A1 * | 3/2003 | Ito et al. | 123/41.86 |
| 2004/0244785 | A1 * | 12/2004 | Nishikawa et al. | 123/574 |
| 2007/0215128 | A1 * | 9/2007 | Yonebayashi et al. | 123/572 |

FOREIGN PATENT DOCUMENTS

JP 2005-307852 11/2005

* cited by examiner

*Primary Examiner*—M. McMahon
(74) *Attorney, Agent, or Firm*—Carrier, Blackman & Associates, P.C.; William D. Blackman; Joseph P. Carrier

(57) ABSTRACT

A breather apparatus for an internal combustion engine which, when casting a cylinder head cover, can improve the fluidity of molten metal and promote gas-liquid separation through effective use of an entire breather chamber. A breather apparatus for an internal combustion engine has a cylinder head cover in which a breather chamber is formed. In the breather chamber, a number of ribs extend from a side wall included in a peripheral wall of the chamber obliquely relative to a direction in which blowby gas flows in through inflow ports. The ribs extend up to where they are continuous with respective fixing bosses. The ribs include projecting lower edge portions which are partly cut out, forming respective concave portions.

20 Claims, 6 Drawing Sheets

ENGINE CYLINDER HEAD COVER WITH INTEGRAL BREATHER APPARATUS, AND ENGINE INCORPORATING SAME

CROSS-REFERENCE TO RELATED APPLICATIONS

The present invention claims priority under 35 USC 119 based on Japanese patent application No. 2006-192429, filed on Jul. 13, 2006, the subject matter of which is incorporated by reference herein.

BACKGROUND OF THE INVENTION

1. Technical Field of the Invention

The present invention relates to a cylinder head cover including an integrally formed breather apparatus, and to an engine incorporating the cylinder head cover.

2. Background Art

Various cylinder head covers have been proposed in which a breather chamber is formed by a peripheral wall projecting inside of the cylinder head cover, and a breather plate covering an opening of the peripheral wall, where plural ribs are formed extending from the peripheral wall in the breather chamber, thereby setting long maze-like blowby gas flow paths so as to promote gas-liquid separation (see published patent document JP-A 2005-307852, for example).

In the cylinder head cover with built-in breather apparatus as disclosed in published patent document JP-A 2005-307852, a number of breather plate fixing bosses project into inner areas of a breather chamber, and ribs extending from a peripheral wall are continuous with the fixing bosses.

Also in the cylinder head cover with built-in breather apparatus as disclosed in published patent document JP-A 2005-307852, the peripheral wall is made up of a combination of side walls extending in the lateral direction and side walls extending in the front-rear direction. Each of the ribs extends perpendicularly from one of the side walls and reaches one of the fixing bosses.

Further in the cylinder head cover with built-in breather apparatus as disclosed in published patent document JP-A 2005-307852, blowby gas inflow ports are formed in laterally extending front walls. Each of the blowby gas inflow ports is faced by a rib extending perpendicularly from a left or right side wall which extends in the front-rear direction.

In the above breather chamber of published patent document JP-A 2005-307852, the ribs extend from the breather chamber side walls extending in the lateral or front-rear direction with each of the ribs reaching one of the fixing bosses. When, in casting the cylinder head cover that includes the breather chamber, molten metal is poured through a casting gate toward one of the side walls, the molten metal is required to follow a complicatedly bent flow path to flow into one of the thin ribs via two or more of the side walls and reach one of the projecting fixing bosses at the end of the rib. This results in a poor fluidity of the molten metal during manufacture of the cylinder head cover.

Moreover, each of the blowby gas inflow ports is faced by one of the ribs extending perpendicularly from one of the side walls extending in the front-rear direction. Therefore, the blowby gas entering the breather chamber through either of the inflow ports squarely hits the rib facing the inflow port and then advances flowing through between the fixing boss with which the end of the rib is continuous and another one of the side walls. This causes a space behind the rib to be left as an unused dead space. Thus, the breather chamber as a whole is not used as effectively as it could be.

SUMMARY OF THE INVENTION

The present invention has been made in view of the above situation, and it is an object of the present invention to provide a breather apparatus for an internal combustion engine which, when casting a cylinder head cover, can improve the fluidity of molten metal and promote gas-liquid separation through effective use of an entire breather chamber.

To achieve the above object, a first aspect of the invention provides a breather apparatus for an internal combustion engine, wherein: a part of a cylinder head cover covering an upper portion of a cylinder head of an internal combustion engine projects upwardly forming a breather chamber, the breather chamber being bounded by a top wall and a peripheral wall and having an open bottom; a plurality of pairs of a fixing boss and a rib project in the breather chamber from an inside surface of the top wall, each pair of the fixing boss and rib being continuous; and the breather chamber is covered by a breather plate fixed to the fixing bosses, the breather chamber being partly partitioned by the ribs thereby setting long flow paths leading from a blowby gas inflow port to a blowby gas outflow port.

In the breather apparatus according to the first aspect hereof, the ribs extend from one side wall included in the peripheral wall obliquely relative to a direction in which the blowby gas flows in through the inflow port, each of the ribs extending up to where it is continuous with one of the fixing bosses; and a projecting lower edge portion of each of the ribs is partly cut out forming a concave portion.

A second aspect of the present invention provides the breather apparatus for an internal combustion engine according to the first aspect of the invention, further characterized in that the peripheral wall has an approximately rectangular cylindrical shape; the inflow port is formed in each of a left and a right portion of one of a pair of opposing long side walls included in the peripheral wall; the outflow port is formed in a part upwardly projecting from a first intermediate portion of the other of the pair of opposing long side walls, the first intermediate portion being closer to one end than to the other end of the other long side wall; the ribs total three, the three ribs being formed extending from a left portion, a right portion, and a second intermediate portion, respectively, of the other long side wall, the second intermediate portion being closer to the other end than to the one end of the other long side wall; and the two ribs extending from the left and right portions of the other long side wall extend obliquely such that they gradually approach each other as they approach the one of the pair of opposing long side walls, and the rib extending from the second intermediate portion extends in a same direction as a closer one of the two ribs.

A third aspect of the present invention provides the breather apparatus according to the second aspect of the invention, further characterized in that the rib extending from the second intermediate portion of the other long side wall is partly in contact with the breather plate; and the two ribs extending from the left and right portions of the other long side wall is not in contact with the breather plate.

A fourth aspect of the present invention provides the breather apparatus for an internal combustion engine according to the first aspect hereof, further characterized in that: the cylinder head cover is incliningly disposed with the side wall from which the ribs extend positioned higher than an opposite side wall; and each of the ribs in contact with the breather plate that is inclined from horizontal has a cutout formed in an end portion thereof, the end portion being substantially continuous with one of the fixing bosses.

In the breather apparatus for an internal combustion engine according to the first aspect of the present invention, all the ribs extend from one side wall included in the peripheral wall, each of the ribs extending up to where it is continuous with one of the fixing bosses. This improves the fluidity of molten metal when casting the cylinder head cover during manufacture thereof. Pouring molten metal through a casting gate such that the molten metal flows toward the one side wall can further improve the fluidity of the molten metal, easily allowing the molten metal to fill the mold portions corresponding to the fixing bosses in a consistent and reproducible way.

Each of the ribs extends obliquely relative to a direction in which the blowby gas flows in through one of the inflow ports with a projecting lower edge portion of the rib partly cut out forming a concave portion. This causes most of the blowby gas flowing in through the inflow port to be guided by the obliquely extending rib to follow a long maze-like flow path, whereas some of the blowby gas is allowed to advance through the concave portion formed in the rib to a space on the back side of the rib (on the side opposite to the inflow port). In this way, the entire breather chamber can be effectively used, causing no dead space to be generated, to promote gas-liquid separation.

In the breather apparatus for an internal combustion engine according to the second aspect of the invention, an inflow port is formed in each of a left and a right portion of one long side wall included in the rectangular cylindrical peripheral wall. An outflow port is formed in a first intermediate portion of the other long side wall, and the first intermediate portion is closer to one end than to the other end of the other long side wall. A total of three ribs are formed extending from a left portion, a right portion, and a second intermediate portion, respectively, of the other long side wall, the second intermediate portion being closer to the other end than to the one end of the other long side wall; and the two ribs extending from the left and right portions of the other long side wall extend obliquely such that they gradually approach each other as they approach the one long side wall, and the rib extending from the second intermediate portion extends in a same direction as a closer one of the two ribs extending from the left and right portions. The blowby gas flows in the breather chamber through the two inflow ports. Most of the blowby gas is then guided by the two ribs extending obliquely from the left and right portions, whereas some of the blowby gas advances, through concave portions formed in the two ribs, to spaces on the back sides of the two ribs. The blowby gas subsequently flows toward a center area of the breather chamber passing all corners of the breather chamber. Of the blowby gas flowing toward the center area, portions reach the rib obliquely extending from the second intermediate portion. Most of the blowby gas reaching the rib obliquely extending from the second intermediate portion is guided by the obliquely extending rib, whereas some of the blowby gas advances, through a concave portion formed in the rib, to a space on the back side of the rib. The whole blowby gas eventually flows out through the outflow port formed in the first intermediate portion.

Thus, with the blowby gas introduced into the breather chamber through the two inflow ports, gas-liquid separation can be efficiently carried out making use of the entire breather chamber without generating any unused dead space.

In the breather apparatus for an internal combustion engine according to the third aspect of the invention, the rib extending from the second intermediate portion of the other long side wall is partly in contact with the breather plate, the rib mainly guiding the blowby gas toward an appropriate center area of the breather chamber thereby allowing the blowby gas to flow smoothly; and the ribs extending from the left and right portions of the other long side wall is not in contact with the breather plate, the ribs allowing some of the blowby gas to advance to spaces on their back sides. Thus, the blowby gas is made to flow passing every corner of the breather chamber to further promote gas-liquid separation.

In the breather apparatus for an internal combustion engine according to the fourth aspect of the invention, the cylinder head cover is incliningly disposed with the side wall from which the ribs extend positioned higher than an opposite side wall; and each of the ribs in contact with the breather plate that is inclined from horizontal has a cutout formed in an end portion thereof, the end portion being continuous with one of the fixing bosses. This allows the oil collecting where the ribs and the bosses are mutually continuous to be discharged through the cutouts.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
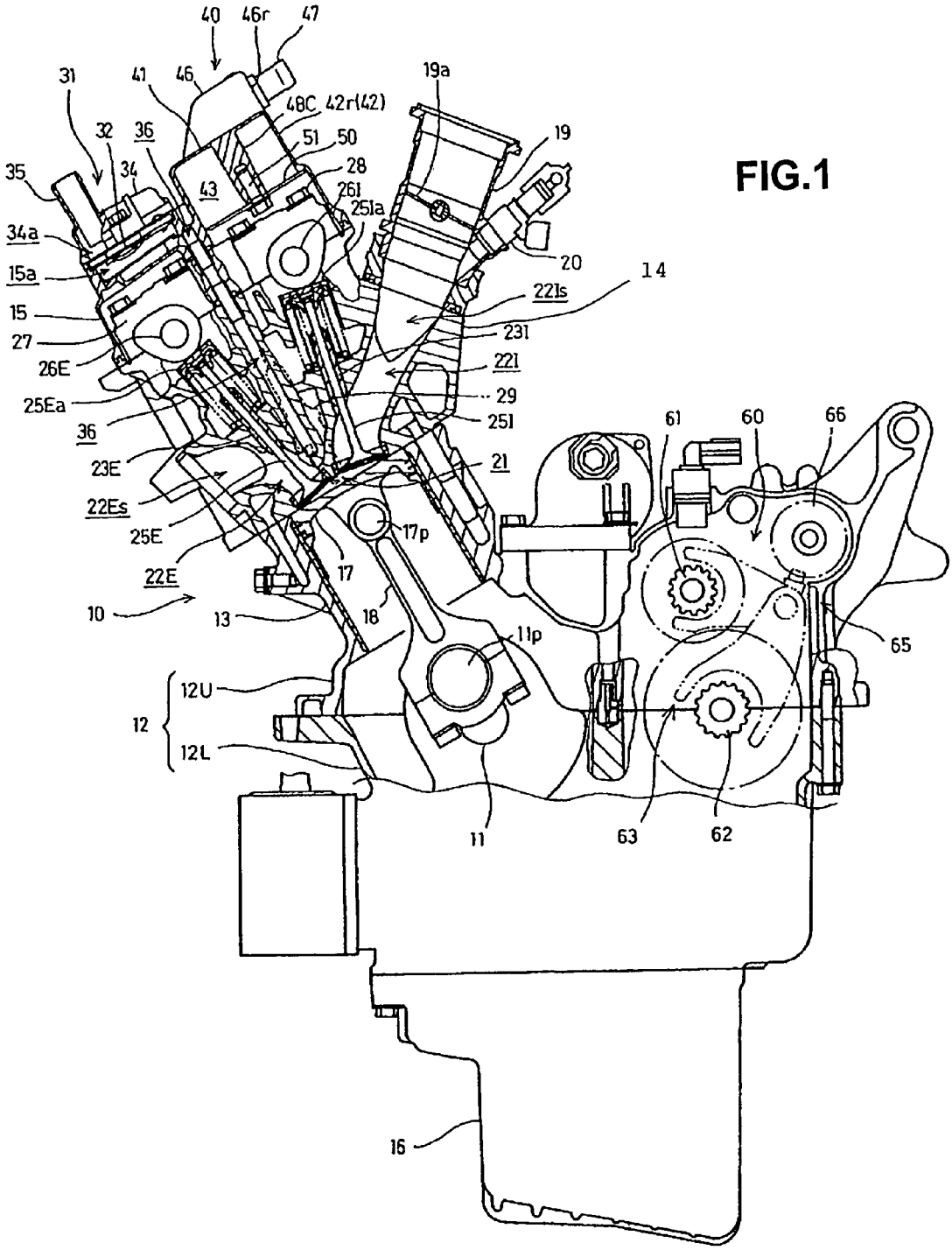
FIG. 1 is a partially cross-sectional left side plan view of an internal combustion engine according to an embodiment of the present invention.

A selected illustrative embodiment of the present invention will now be described, with reference to the drawing FIGS. 1 to 6. In the present specification, the relative directional terms front, rear, left, right, upper and lower are described from the vantage point of a user of a motorcycle on which an internal combustion engine is transversely mounted, where the user is seated on the vehicle and facing forward.

An internal combustion engine 10 according to the illustrative embodiment is a water-cooled, double overhead cam (DOHC), four-cylinder, four-stroke engine. It is adapted to be mounted transversely on a motorcycle frame (not shown), with a crankshaft 11 thereof oriented transverse to a longitudinal axis of the motorcycle frame.

FIG. 1 is a cross-sectional view of the internal combustion engine 10. Referring to FIG. 1, the engine 10 includes a crankcase 12 having an upper part 12U and a lower part 12L. A cylinder block 13 is projectingly formed on the upper crankcase 12U, in a position inclined forwardly from a vertical orientation, as shown. A cylinder head and a cylinder head cover 15 are integrally clamped on the cylinder block 13, in a position inclined somewhat forwardly from vertical. An oil pan 16 is provided under a lower crankcase 12L.

Inside of the engine 10, a connecting rod 18 extends between and interconnects a crank pin 11*p* of a crankshaft 11 and a piston pin 17*p* of a piston 17, which is slidably fitted in a cylinder bore of the cylinder block 13.

The crankcase 12 also accommodates a transmission 60 disposed internally therein rearward of the crankshaft 11. A main shaft 61 of the transmission 60 is journaled rearward and obliquely above the crankshaft 11 to be rotatable in parallel with the crankshaft 11. The crankshaft 11 transmits power to the main shaft 61 via gear engagement between them (not shown).

A countershaft 62 is journaled below the main shaft 61 to be rotatable in parallel with the main shaft 61. A transmission gear group 63, which is an assembly of gear trains for setting a gear ratio, is configured between the two shafts, allowing a transmission drive mechanism 65 to change a gear ratio using a shift drum 66.

The countershaft 62 serves as an output shaft.

A combustion chamber 21 is formed between the top of the piston 17 and the ceiling, facing the piston top, of the cylinder head 14. A pair of left and right intake openings are provided in a rear half of the combustion chamber 21 with a pair of left and right intake ports 22I extending rearwardly from the intake openings. The pair of left and right intake ports 22I join into a common intake passage 22Is leading to a throttle body 19.

The throttle body 19 has a fuel injection valve 20 for injecting fuel to an area of the intake passage 22Is downstream of a throttle valve 19*a*.

A pair of left and right exhaust openings are provided in a front half of the combustion chamber 21 with a pair of left and right exhaust ports 22E extending forwardly from the exhaust openings. The left and right exhaust ports 22E join together into a common exhaust passage 22Es.

Each of the intake openings, through which the respective intake ports 22I are communicated with the combustion chamber 21, is opened and closed by an intake valve 25I having a valve stem slidably supported through a valve guide 23I. A cam lobe of an intake camshaft 26I, in contact with a valve lifter 25Ia at a top end of the valve stem, pushes the intake valve 25I to drive it.

Similarly, each of the left and right exhaust openings, through which the respective exhaust ports 22E are communicated with the combustion chamber 21, is opened and closed by an exhaust valve 25E having a valve stem slidably supported through a valve guide 23E. A cam lobe of an exhaust camshaft 26E in contact with a valve lifter 25Ea at a top end of the valve stem pushes the exhaust valve 25E to drive it.

The intake camshaft 26I and exhaust camshaft 26E are each rotatably journaled, in a manner of being sandwiched, by a camshaft holder 27 clamped by bolts 28 to a shaft holder section of the cylinder head 14. They are rotationally driven by a power transmission mechanism (not shown) at a rotation speed half that of the crankshaft 11.

In the cylinder head 14, a spark plug 29 is fitted at a center portion of the ceiling wall of the combustion chamber 21 with an electrode at its end exposed in the combustion chamber 21.

The cylinder head cover 15 is disposed over the cylinder head 14, covering a valve operating mechanism which is configured on the cylinder head 14 and which includes the intake camshaft 26I and exhaust camshaft 26E.

The cylinder head cover 15 is provided with a breather apparatus 40 according to a selected illustrative embodiment of the present invention, and the breather apparatus is disposed above the intake camshaft 26I. The breather apparatus 40 will be described in further detail subsequently herein. The cylinder head cover 15 is also provided with a secondary air control device 31 disposed above the exhaust camshaft 26E (see FIG. 1).

One secondary air control device 31 is provided for each cylinder. The secondary air control device 31 has an upwardly projectingly formed reed valve container 33 in which a secondary air reed valve 32 for a cylinder is installed. Of the four reed valve containers 33, the two on the left and the two on the right are adjacently disposed, respectively, with each of the reed valve containers 33 having a rectangular open top (see FIG. 2). The open tops of each pair of the adjacent reed valve containers 33 are covered by a common valve cover 34. The secondary air reed valve 32 installed in each of the reed valve containers 33 separates an upstream valve chamber 34*a* covered by the valve cover 34 and a downstream valve chamber 15*a* on the cylinder head cover 15 side.

An intake pipe 35 projects from the valve cover 34, for introducing secondary air from an air cleaner included in an intake system of the internal combustion engine 10 into the upstream valve chamber 34*a*.

A secondary air passage 36 extends downwardly from an opening in the downstream valve chamber 15*a* in the cylinder head cover 15.

The secondary air passage 36 is formed by boring downwardly through the cylinder head cover 15, camshaft holder 27, and cylinder head 14 so that the bore is open to the exhaust port 22E (see FIG. 1).

Thus, the downstream valve chamber 15*a*, downstream of the secondary air reed valve 32, communicates with the exhaust port 22E through the secondary air passage 36. The secondary air reed valve 32, therefore, alternately opens and closes in response to exhaust pulsations generated in the exhaust port 22E, thereby causing secondary air to be drawn into the exhaust port 22E through the secondary air passage 36. The secondary air introduced into the exhaust port 22E is mixed with the exhaust gas therein to oxidize, for purification, unburned components such as HC and CO contained in the exhaust gas.

Figure 1A:
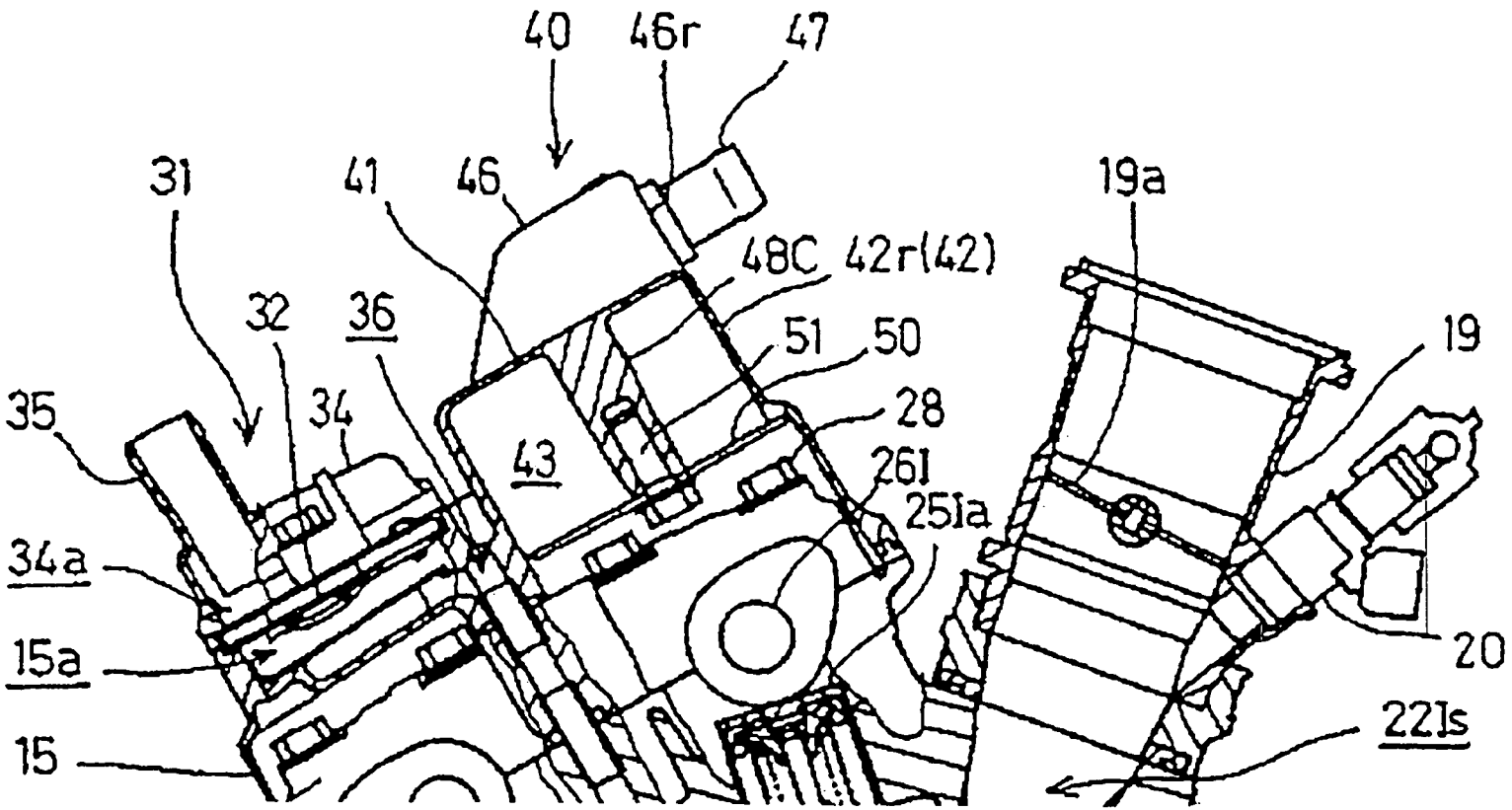
FIG. 1A is a detail view of a top portion of FIG. 1, showing structural features of a breather apparatus formed in a cylinder head cover of the engine.

Referring now to FIG. 1A, the breather apparatus 40, formed in the cylinder head cover 15, has a breather chamber 43 formed therein extending upwardly above the intake camshaft 26I. The breather chamber 43 is surrounded by a top wall 41 and a peripheral wall 42, and has an open bottom.

The peripheral wall 42 includes long side walls, i.e. a front wall 42*f* and a rear wall 42*r*, and has a modified, approximately rectangular shape as will be further described herein.

Of the long side walls, the front wall 42*f* has concave portions 42*fa* formed to stretch along curved portions of two central plug insertion openings 44 respectively disposed on the left and on the right. Inflow ports 45L and 45R are formed in left and right open end portions of the front wall 42*f*, the left and right open end portions being located between the concave portions 42*fa* on the left and between the concave portions 42*fa* on the right, respectively (see FIGS. 3 and 4).

Figure 2:
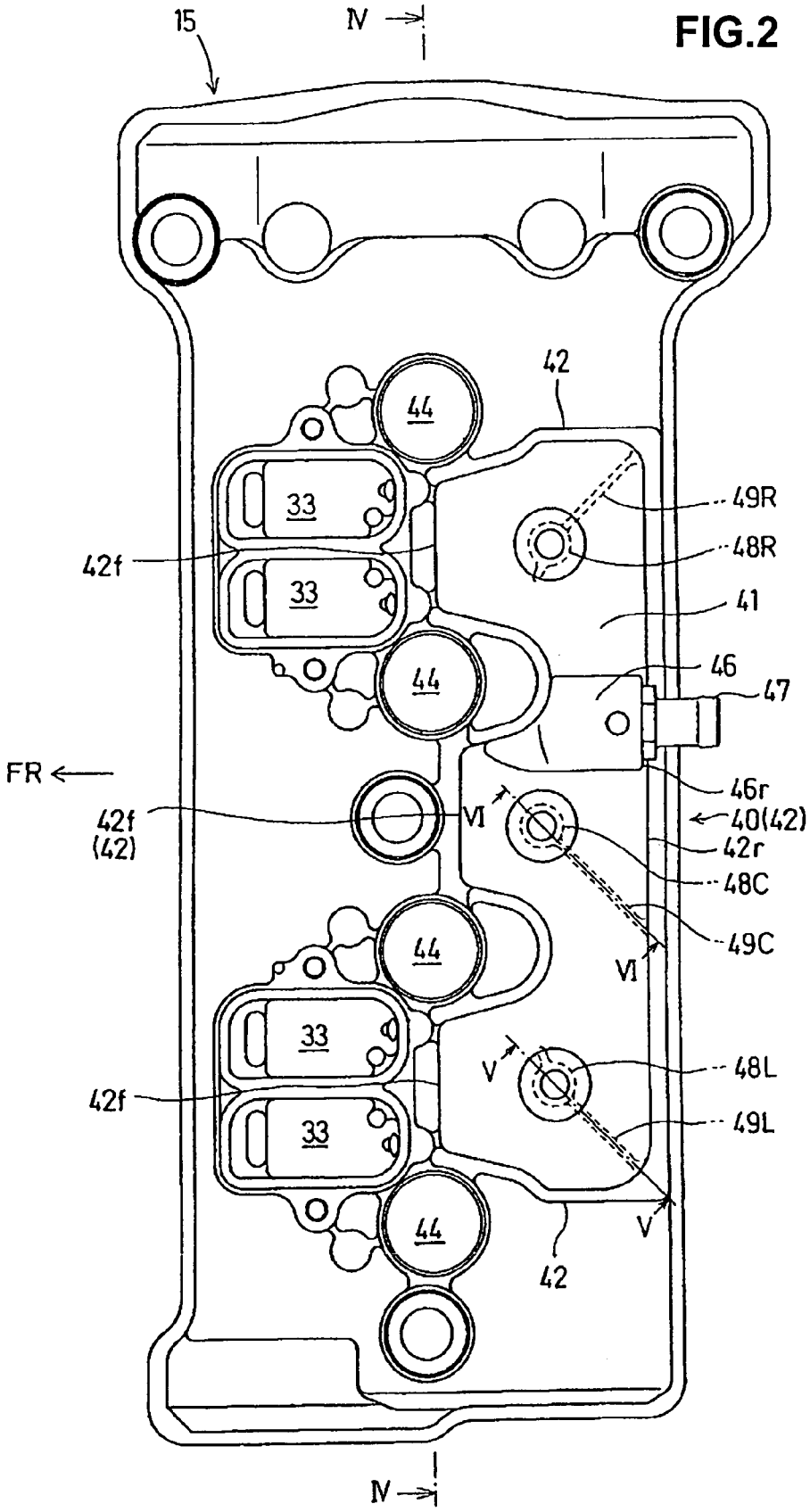
FIG. 2 is a top plan view of the cylinder head cover of the engine of FIG. 1.

A projecting portion 46 projects upwardly, mostly on the right side, from the top wall 41 of the breather chamber. The projecting portion 46 has a rear wall 46*r*, which is an upward extension of a central portion of the long rear wall 42*r*, and this rear wall 46*r* is provided with an outflow connection pipe 47 attached thereto and extending rearwardly therefrom, as an outlet from the breather chamber 43. The outflow connection pipe 47 may be removably threadably attached to the rear wall 46*r* of the cylinder head cover 15, and may have an integral hex-shaped bolt boss 47*h* surrounding the base of the pipe, as shown in FIG. 2. In the depicted embodiment, three fixing bosses 48L, 48C, and 48R are provided on the inner surface of the top wall 41. The fixing bosses 48L, 48C, and 48R project downwardly from left, center, and right locations, respectively, in a central portion in the front-rear direction of the inner surface of the top wall 41. The lower end faces of the fixing bosses 48L, 48C, and 48R are aligned substantially in a plane with the open end face of the peripheral wall 42.

The left fixing boss 48L and right fixing boss 48R are disposed to oppose the inflow ports 45L and 45R, respectively, formed through the front wall 42*f* of the breather chamber.

Left and right ribs 49L and 49R are formed to extend obliquely forwardly from rear left and rear right corners, respectively, of the peripheral wall 42 having an approximately rectangular shape. These ribs 49L, 49R are shown in phantom in FIG. 2, and are shown in solid lines in FIG. 3, since they are located on the lower surface of the cylinder head cover 15.

In this way, the left and right ribs 49L and 49R extend obliquely forwardly from the corners of the chamber, gradually approaching each other from left and right end portions of the rear wall 42*r*, up to where they are integrally joined with the left and right fixing bosses 48L and 48R, respectively.

A center rib 49C extends obliquely forwardly from a first intermediate portion which is closer to the left end of the rear wall 42*r*, unlike the outflow connection pipe 47. The center rib 49C is oriented substantially parallel to the left rib 49L, and the forward end of the center rib is continuous with, and integrally formed with the center fixing boss 48C.

Projections 48La and 48Ra are formed extending slightly forwardly from the left and right fixing bosses 48L and 48R, respectively, toward the concave portions 42*fa* so as to somewhat control directions of blowby gas flows.

A breather plate 50 is disposed abutting against the open end face of the peripheral wall 42, and the breather plate 50 is in contact with the lower end faces of the fixing bosses 48L, 48C, and 48R that are substantially coplanar with the open end face of the peripheral wall 42. The breather plate 50 is a plate member shaped approximately the same as a contour along the outer periphery of the open end face of the peripheral wall 42 (i.e. approximately rectangular with its front long side including two left and right concave portions). In this state, three bolts 51 are screwed in the fixing bosses 48L, 48C, and 48R, respectively, through the breather plate 50 and tightened to thereby cover the breather chamber 43 inside the peripheral wall 42 (see FIG. 1).

Figure 5:
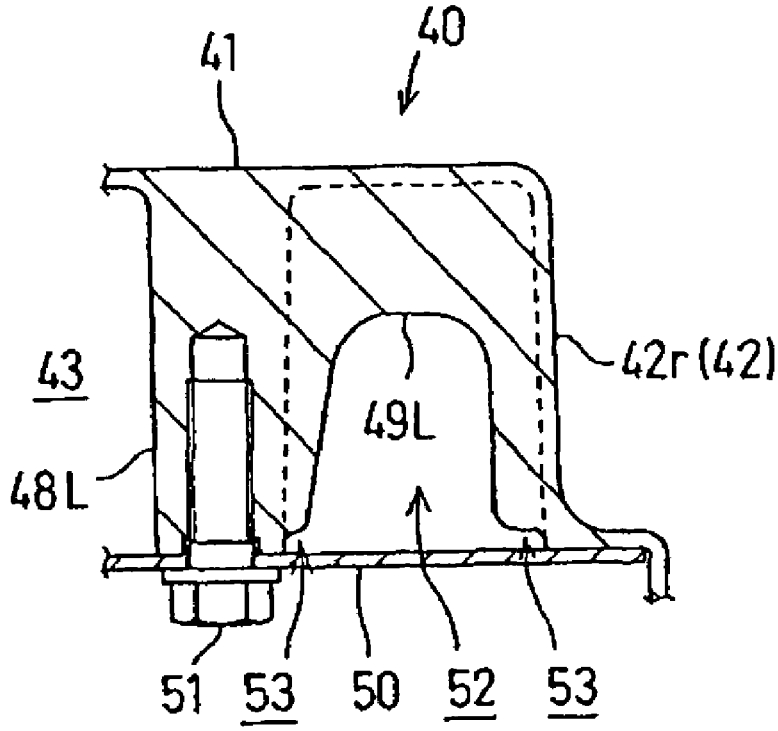
FIG. 5 is a cross-sectional view of the cylinder head cover of FIGS. 1-2, taken along line V-V in FIG. 2.

Referring to the sectional view shown in FIG. 5, the left rib 49L has a concave portion 52 formed therein by largely cutting out a lower end center portion thereof. Lower end portions of the left rib 49L, on the two sides of the concave portion 52, are not in contact with the breather plate 50, that is, there are clearances 53 between the lower end portions and the breather plate 50.

The right rib 49R is shaped substantially the same as the left rib 49L.

Figure 6:
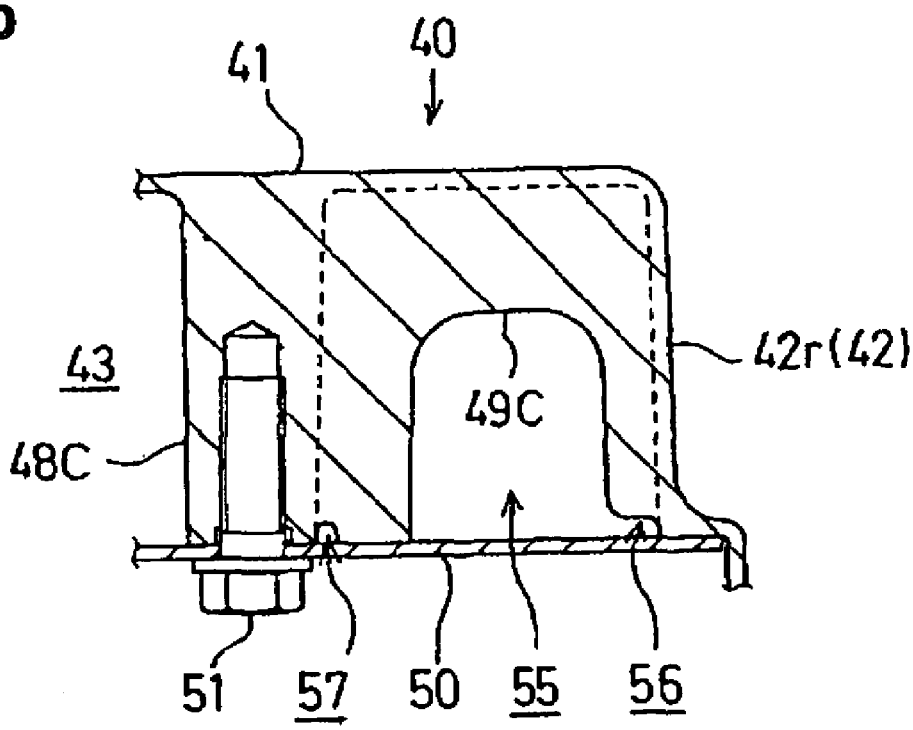
FIG. 6 is a cross-sectional view of the cylinder head cover of FIGS. 1-2, taken along line VI-VI in FIG. 2.

Referring to the sectional view shown in FIG. 6, the center rib 49C has a concave portion 55 formed by largely cutting out a lower end center portion thereof. A lower end portion of the center rib 49C, adjoining the front wall 42*f*, is not in contact with the breather plate 50, that is, there is a clearance 56 between the lower end portion and the breather plate 50. A lower end portion of the center rib 49C adjoining the fixing boss 48C, is in contact with the breather plate 50, but it has a cutout 57 formed along the fixing boss 48C. With the breather plate 50 abutted against the lower end portion of the center rib from below, the cutout 57 forms a hole through the lower end portion.

The configuration of the breather apparatus 40 has been described. In the breather chamber 43 formed within the cylinder head cover and covered from below by the breather plate 50, the ribs 49L, 49C, and 49R extend obliquely forwardly from a left end portion, a first intermediate portion closer to the left end portion, and a right end portion of the rear wall 42*r*, up to where they are continuous with the fixing bosses 48L, 48C, and 48R, respectively, thereby partly partitioning the inside of the breather chamber 43. In order to promote gas-liquid separation of the blowby gas, blowby gas flow paths extend long and maze-like from the left and right inflow ports 45L and 45R formed, at two locations, through the front wall 42*f* to the outflow connection pipe 47 that is formed as an outlet through the rear wall 46*r* of the projecting portion 46 upwardly projectingly formed above a portion of the rear wall 42*r*.

The flow of blowby gas in the breather chamber 43 will now be described, with reference to FIG. 3.

Figure 3:
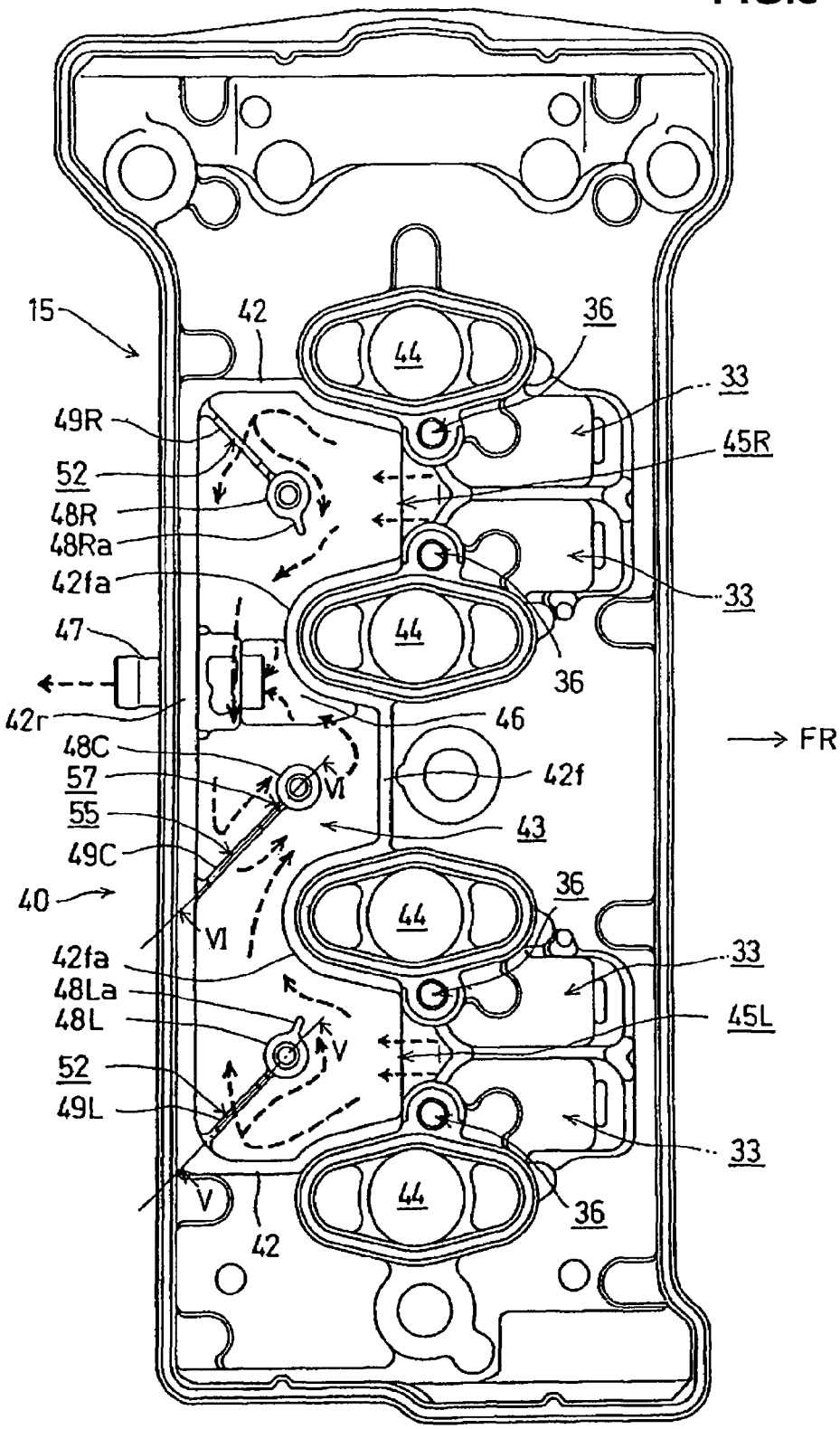
FIG. 3 is a bottom plan view of the cylinder head cover.
Figure 4:
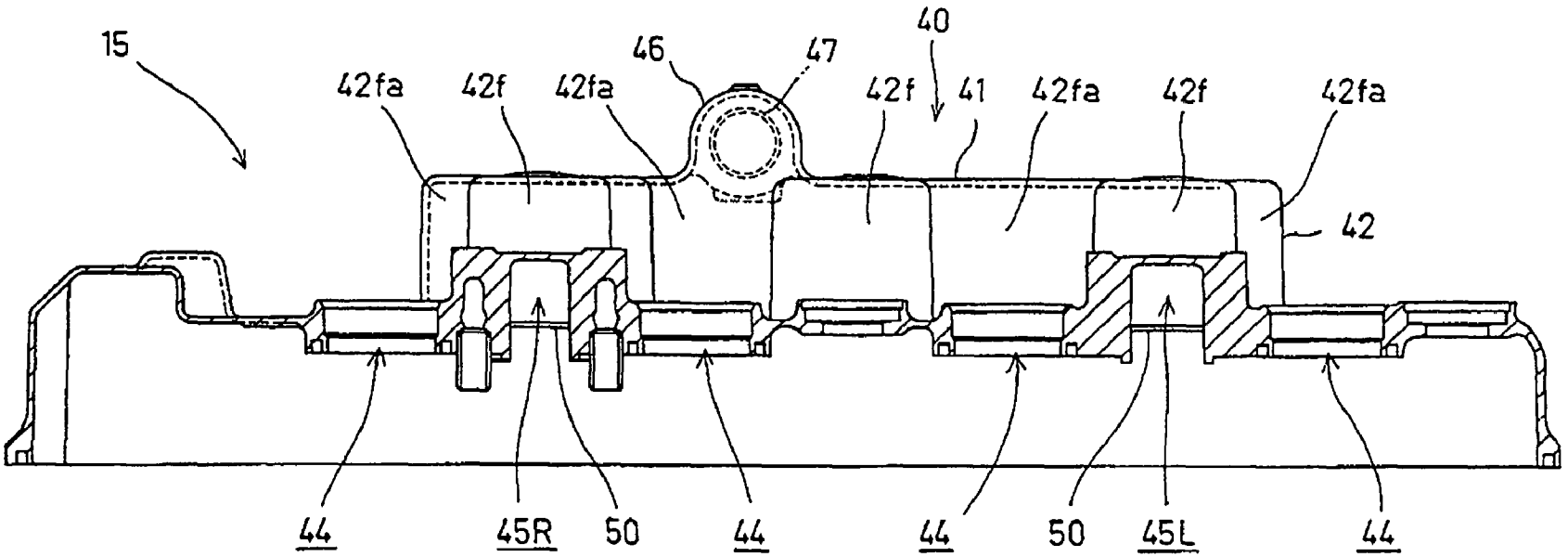
FIG. 4 is a cross-sectional view of the cylinder head cover of FIGS. 1-2, taken along line IV-IV in FIG. 2.

In FIG. 3, broken-line arrows indicate blowby gas flows.

The blowby gas coming in through the right inflow port 45R is divided into a leftward flow and a rightward flow. The leftward flow heads (leftward) for a center area advancing through between the fixing boss 48R and the nearby concave portion 42*fa* of the front wall 42*f*. The rightward flow is, after advancing rearward along the inner surface of the peripheral wall 42, divided into an upper and a lower layer. The upper layer flow makes a U-turn to advance obliquely forward along the front side of the obliquely extending right rib 49R and turns around the fixing boss 48R to head for the center area. The lower layer flow advances to a space on the rear side (back side) of the right rib 49R through the concave portion 52 and clearances 53 formed by the right rib 49R to further advance toward the center area.

If the right rib 49R does not have the concave portion 52, the space on the back side of the right rib 49R becomes a useless dead space. The concave portion 52 and clearances 53 make it possible to effectively use the whole of the breather chamber without generating such a dead space.

As described above, the entire blowby gas coming in through the right inflow port 45R eventually heads for the center area. Whereas most of the blowby gas heading for the center area flows out through the projecting portion 46 projectingly formed on the top wall 41 and the outflow connection pipe 47 to advance toward the air cleaner, some of the blowby gas further advances toward the center rib 49C without entering the projecting portion 46.

The portion further advancing toward the center rib 49C of the blowby gas reaches a space on the back side of the center rib 49C, thus making the space useful, and is divided into an upper layer and a lower layer. The upper layer flow makes a U-turn to advance obliquely forward along the back side of the obliquely extending center rib 49C and again reaches the projecting portion 46 to subsequently flow out through the projecting portion 46 and the outflow connection pipe 47. The lower layer flow advances to the front side of the center rib 49C through the concave portion 55 and clearance 56 formed by the center rib 49C to further advance obliquely forward along the front side of the center rib 49C.

It is as a result of induction by the blowby gas coming in through the left inflow port 45L, being described in the following, that the lower layer flow is caused to advance obliquely forward along the front side of the center rib 49C.

The blowby gas coming in through the left inflow port 45L is divided into a leftward flow and a rightward flow. The rightward flow heads (rightward) for the center area advancing through between the fixing boss 48L and the nearby concave portion 42*fa* of the front wall 42*f*. The leftward flow is, after advancing rearward along the inner surface of the peripheral wall 42, divided into an upper and a lower layer. The upper layer flow makes a U-turn to advance obliquely forward along the front side of the obliquely extending left rib 49L and turns around the fixing boss 48L to head for the center area. The lower layer flow advances to a space on the rear side (back side) of the left rib 49L through the concave portion 52 and clearances 53 formed by the left rib 49L to further advance toward the center area.

The same as described above in connection with the right rib 49R, the concave portion 52 and clearances 53 formed by the left rib 49L make it possible to effectively use the whole breather chamber without generating any dead space.

Thus, the entire blowby gas coming in through the left inflow port 45L eventually heads for the center rib 49C.

This blowby gas flow subsequently advances obliquely forward along the front side of the center rib 49C thereby inducing the above-described portion of the blowby gas coming, after coming in through the right inflow port 45R, through the concave portion 55 and clearance 56 formed by the center rib 49C to advance together in the same direction. The blowby gas flow thus advancing along the front side of the center rib 49C turns around the fixing boss 48C and enters the projecting portion 46 to then flow out through the outflow connection pipe 47.

As described above, most of the blowby gas coming into the breather chamber 43 through the two inflow ports 45L and 45R formed through the front wall 42*f* follows, being guided by the ribs 49L, 49C, and 49R obliquely forwardly extending from the rear wall 42*r*, long maze-like paths, whereas some of the blowby gas advances to spaces on the back sides (on the sides opposite to the inflow ports 45L and 45R, respectively) of the ribs 49L, 49C, and 49R through the concave portions 52 and 55 (and the clearances 53 and 56) allowing no dead space to be generated. This makes it possible to effectively use the whole breather chamber 43 without generating any dead space, so that gas-liquid separation of the blowby gas can be further promoted.

A lower end portion of the center rib 49C is in contact with the breather plate 50. This minimizes mixing between the blowby gas flowing along the front side of the center rib 49C and the blowby gas flowing along the back side of the center rib 49C, so that the blowby gas flows are smoothly guided to achieve higher circulation efficiency and promote gas-liquid separation.

The cylinders of the internal combustion engine 10 are somewhat inclined forwardly, so that the breather plate 50 is also forwardly inclined. The oil generated as a result of gas-liquid separation taking place on the inside surface of the peripheral wall 42 and on the front and back sides of the ribs 49L, 49C, and 49R drips and collects on the breather plate 50, and then flows forward on the breather plate 50. With the lower end of the center rib 49C partly in contact with the breather plate 50 and with the front end of the center rib 49C being continuous with the center fixing boss 48C, the oil flowing forward along the back side of the center rib 49C tends to collect at the projecting portion of the center fixing boss 48C.

The center rib 49C whose lower end is partly in contact with the breather plate 50, however, has the cutout 57 formed where its lower end is continuous with the center fixing boss 48C, so that the breather plate 50 covering the cutout 57 turns the cutout 57 into a through hole. The oil collecting where the center rib 49C and the center fixing boss 48C are continuous can therefore be discharged through the through hole.

In the cylinder head cover 15, all the ribs 49L, 49C, and 49R extend obliquely forwardly from the rear wall 42*r* included in the peripheral wall forming the breather chamber 43, the front ends of the ribs being continuous with the fixing bosses 48L, 48C, and 48R, respectively. Therefore, in casting the cylinder head cover 15, pouring molten metal through a casting gate such that the molten metal flows from a rear portion of a mold forward allows, with ease, the molten metal to flow smoothly to fill the mold portions corresponding to the fixing bosses 48L, 48C, and 48R without fail.

The above configuration is therefore suitable when casting molten metal with a relatively low fluidity into a cylinder head cover.

It is particularly suitable when casting, to produce a light-weight cylinder head cover, a magnesium alloy with a lower castability than that of an aluminum alloy.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A cylinder head cover for an internal combustion engine having a cylinder head, said cylinder head cover covering an upper portion of said cylinder head and having a breather apparatus formed therein, said breather apparatus comprising a part of the cylinder head cover which projects upwardly and which comprises a top wall and a peripheral wall which cooperate to define a breather chamber having an open bottom;

said breather apparatus further comprising a plurality of component pairs which project from an inside surface of the top wall in the breather chamber, each component pair comprising a fixing boss and a rib which is coextensive and integrally formed with its associated fixing boss;

wherein the cylinder head cover further comprises a breather plate fixed to the fixing bosses, the breather plate effectively covering the open bottom of the breather chamber, the breather chamber being partly partitioned by the ribs thereby defining a plurality of gas flow paths leading from a blowby gas inflow port to a blowby gas outflow port;

wherein each of the ribs extends obliquely from a respective side portion of the peripheral wall, relative to a direction in which blowby gas flows in through the inflow port, each of the ribs extending up to where it is continuous with one of the fixing bosses; and wherein each of the ribs has a projecting lower edge portion which is partly cut out forming a concave portion.

2. The breather apparatus according to claim 1, wherein:

the peripheral wall has an approximately rectangular cylindrical shape;

the inflow port is formed in each of a left and a right portion of one of a pair of opposing long side walls included in the peripheral wall;

the outflow port is formed in a part upwardly projecting from a first intermediate portion of the other of the pair of opposing long side walls, the first intermediate portion being closer to one end than to the other end of the other long side wall;

the ribs total three, the three ribs being formed extending from a left portion, a right portion, and a second intermediate portion, respectively, of the other long side wall, the second intermediate portion being closer to the other end than to the one end of the other long side wall; and the two ribs extending from the left and right portions of the other long side wall extend obliquely such that they gradually approach each other as they approach the one of the pair of opposing long side walls, and the rib extending from the second intermediate portion extends in a same direction as a closer one of the two ribs.

3. The breather apparatus according to claim 2, wherein:

the rib extending from the second intermediate portion of the other long side wall is partly in contact with the breather plate; and the two ribs extending from the left and right portions of the other long side wall is not in contact with the breather plate.

4. The breather apparatus according to claim 1, wherein:

the cylinder head cover is inclingly disposed with the side wall from which the ribs extend positioned higher than an opposite side wall; and each of the ribs in contact with the breather plate that is inclined from horizontal has a cutout formed in an end portion thereof, the end portion being continuous with one of the fixing bosses.

5. The cylinder head cover of claim 1, further comprising at least one secondary air control device configured for placement above a camshaft.

6. The cylinder head cover of claim 5, wherein said secondary air control device comprises an upwardly projecting reed valve container, and a secondary air reed valve installed in said reed valve container.

7. The cylinder head cover of claim 6, wherein the cylinder head cover comprises two adjacently disposed reed valve containers on a first side thereof, and two adjacently disposed reed valve containers on another side thereof, with each of the reed valve containers having a rectangular open top.

8. The cylinder head cover of claim 7, further comprising two valve covers, wherein the open tops of each pair of adjacent reed valve containers are covered by a common one of said valve covers.

9. The cylinder head cover of claim 8, wherein the secondary air reed valve installed in each of the respective reed valve containers separates an upstream valve chamber covered by the valve cover, and a downstream valve chamber below said air reed valve.

10. An internal combustion engine, comprising:

a cylinder head;

a cylinder head cover covering an upper portion of said cylinder head and having a breather apparatus formed therein, said breather apparatus comprising a part of the cylinder head cover which projects upwardly and which comprises a top wall and a peripheral wall which cooperate to define a breather chamber having an open bottom;

said breather apparatus further comprising a plurality of component pairs which project from an inside surface of the top wall in the breather chamber, each component pair comprising a fixing boss and a rib which is coextensive and integrally formed with its associated fixing boss;

wherein the cylinder head cover further comprises a breather plate fixed to the fixing bosses, the breather plate effectively covering the open bottom of the breather chamber, the breather chamber being partly partitioned by the ribs thereby defining a plurality of gas flow paths leading from a blowby gas inflow port to a blowby gas outflow port;

wherein each of the ribs extends obliquely from a respective side portion of the peripheral wall, relative to a direction in which blowby gas flows in through the inflow port, each of the ribs extending up to where it is continuous with one of the fixing bosses; and wherein each of the ribs has a projecting lower edge portion which is partly cut out forming a concave portion.

11. The internal combustion engine of claim 10, wherein:

the peripheral wall has an approximately rectangular cylindrical shape;

the inflow port is formed in each of a left and a right portion of one of a pair of opposing long side walls included in the peripheral wall;

the outflow port is formed in a part upwardly projecting from a first intermediate portion of the other of the pair of opposing long side walls, the first intermediate portion being closer to one end than to the other end of the other long side wall;

the ribs total three, the three ribs being formed extending from a left portion, a right portion, and a second intermediate portion, respectively, of the other long side wall, the second intermediate portion being closer to the other end than to the one end of the other long side wall; and the two ribs extending from the left and right portions of the other long side wall extend obliquely such that they gradually approach each other as they approach the one of the pair of opposing long side walls, and the rib extending from the second intermediate portion extends in a same direction as a closer one of the two ribs.

12. The internal combustion engine of claim 10, wherein:

the rib extending from the second intermediate portion of the other long side wall is partly in contact with the breather plate; and the two ribs extending from the left and right portions of the other long side wall is not in contact with the breather plate.

13. The internal combustion engine of claim 10, wherein:

the cylinder head cover is inclingly disposed with the side wall from which the ribs extend positioned higher than an opposite side wall; and each of the ribs in contact with the breather plate that is inclined from horizontal has a cutout formed in an end portion thereof, the end portion being continuous with one of the fixing bosses.

14. The internal combustion engine of claim 10, further comprising a camshaft disposed below said cylinder head cover, and wherein said cylinder head cover further comprises at least one secondary air control device situated above the camshaft.

15. The internal combustion engine of claim 14, wherein said secondary air control device comprises an upwardly projecting reed valve container, and a secondary air reed valve installed in said reed valve container.

16. The internal combustion engine of claim 14, wherein said secondary air control device comprises two adjacently disposed reed valve containers on a first side thereof, and two adjacently disposed reed valve containers on another side thereof, with each of the reed valve containers having a rectangular open top.

17. The internal combustion engine of claim 16, further comprising two valve covers, wherein the open tops of each pair of adjacent reed valve containers are covered by a common one of said valve covers.

18. The internal combustion engine of claim 17, wherein the secondary air reed valve installed in each of the respective reed valve containers separates an upstream valve chamber covered by the valve cover, and a downstream valve chamber below said air reed valve.

19. The internal combustion engine of claim 18, further comprising an intake pipe attached to and projecting from the valve cover for introducing secondary air from an air cleaner into the upstream valve chamber.

20. The internal combustion engine of claim 19, wherein the cylinder head cover has a secondary air passage formed therein and extending downwardly from an opening in the downstream valve chamber.

* * * * *